US010677404B2

(12) United States Patent
Kim

(10) Patent No.: US 10,677,404 B2
(45) Date of Patent: Jun. 9, 2020

(54) EMERGENCY LIGHT SYSTEM HOUSING WITH TWO REPLACEABLE COVERS

(71) Applicant: Sun Kyoung Kim, Seoul (KR)

(72) Inventor: Sun Kyoung Kim, Seoul (KR)

( * ) Notice: Subject to any disclaimer, the term of this patent is extended or adjusted under 35 U.S.C. 154(b) by 0 days.

(21) Appl. No.: 15/882,586

(22) Filed: Jan. 29, 2018

(65) Prior Publication Data

US 2019/0234592 A1 Aug. 1, 2019

(51) Int. Cl.

| | |
|---|---|
| ***F21S 9/02*** | (2006.01) |
| ***F21V 21/30*** | (2006.01) |
| ***F21V 3/06*** | (2018.01) |
| ***F21V 3/02*** | (2006.01) |
| *G08B 5/36* | (2006.01) |

(52) U.S. Cl.

CPC ..... *F21S 9/022* (2013.01); *F21V 3/02* (2013.01); *F21V 3/062* (2018.02); *F21V 21/30* (2013.01); *G08B 5/36* (2013.01)

(58) Field of Classification Search

CPC ..... F21S 9/022; F21S 9/024; F21V 21/30
USPC ..... 362/249.1, 528, 421
See application file for complete search history.

(56) References Cited

U.S. PATENT DOCUMENTS

| | | | | |
|---|---|---|---|---|
| 6,019,477 A * | 2/2000 | Wegrzyn | F21S 9/022 | 362/20 |
| 6,741,324 B1 * | 5/2004 | Kim | G09F 19/22 | 362/235 |
| 7,182,487 B1 * | 2/2007 | Pickard | F21S 9/022 | 174/535 |

* cited by examiner

*Primary Examiner* — Sean P Gramling
(74) *Attorney, Agent, or Firm* — Stephen Chai

(57) ABSTRACT

Emergency light system housing, with two replaceable covers is invented to supplement the prior art, U.S. Pat. No. 6,741,324 B1.

The disadvantage of prior art is that it does not permit the cover of emergency light system housing to be replaceable. However, the present invention resolved this disadvantage by the way that it, creatively positions three connecting members on the cover and positions three holes on the housing.

Three connecting members on the emergency light cover come to be respectively combined into three holes on the emergency light system housing.

The shape of emergency light cover could be various as far as three connecting members on the emergency light cover are Properly positioned as described in the claim so that they come to be respectively combined into three holes on the emergency light system housing.

The present invention could reduce an economic burden on an user because he or she could change only a different shape of emergency light cover with an existing cover without a need to change an entire emergency light system including housing with a circuit board and two covers with new one.

In addition, the present invention is designed to shed a light in any direction by attaching the replaceable cover and the movable ball-shaped emergency light with a movable plastic circle.

However, the movable emergency light is designed neither to be turned left or right side beyond 360 degree because of both one protruded-up and square-shaped object attached to the plastic moving circle and one blocking object located in the respective replaceable cover, nor to be turned downward or upwards beyond 80 degree because of both two protruded-up cross-shaped lines on each surface of two respective plastic ball-shaped covers and two respective smaller holes located in the movable plastic circle.

13 Claims, 16 Drawing Sheets

EMERGENCY LIGHT SYSTEM HOUSING WITH TWO REPLACEABLE COVERS

CROSS REFERENCE TO RELATED APPLICATIONS

U.S. Pat. No. 6,741,324 B1 Inventor: Il Kim

FIELD OF INVENTION

The present invention relates to an emergency light system housing with a replaceable cover. The present invention is exactly the same as the prior art mentioned above in respect of the way how the emergency light system functions. The difference between the present invention and the prior art is that the present invention is designed to easily replace an current emergency light system cover with any other type of cover which an owner of the emergency light system likes to change without a need to change the emergency light system housing.

The emergency light system housing with a replaceable cover comprises first, a housing containing a circuit board and second a replaceable cover with emergency light being attached.

As to the emergency light system housing (denoted as "housing" below, the middle part of the housing protrudes up so that the circuit board shall be placed in empty space formed inside of protruded-up middle part of housing. The protruded-up middle part of housing has both a right-sided and a left-sided wall, which are slightly inclined.

The left-sided wall of protruded-up middle part (denoted as "the left-sided wall" below) of the housing has a long rectangular hole located in the bottom middle of the left-sided wall so that two electric lines shall be connected between a left-sided emergency light attached to the left replaceable cover and a circuit board located inside of protruded-up middle part of housing.

The left-sided wall also has a rectangular hole in the upper middle of the left-sided wall so that a connecting push-in member attached to a left-sided replaceable cover could be pushed into the mentioned rectangular hole.

The left-sided wall has another long rectangular hole located in the left-side of the mentioned long rectangular hole so that air could freely circulate between the empty space formed inside the housing containing a circuit board and the left replaceable cover with emergency light being attached while the housing and the left replaceable cover are being attached to each other.

The right-sided wall of protruded-up middle part (denoted as "the right-sided wall" below) of the housing has a long rectangular hole located in the bottom middle of the right-sided wall so that two electric lines shall be connected between a right-sided emergency light attached to the right replaceable cover and a circuit board located inside of protruded-up middle part of housing.

The right-sided wall has a rectangular hole in the upper middle of the right-sided wall so that a long connecting push-in member attached to a right-sided replaceable cover could be pushed into the mentioned rectangular hole.

The left-side bottom surface of protruded-up middle part of housing containing a circuit board (denoted as "left-side bottom surface" below) has a rounded hole on the surface so that a rounded cover of left emergency light shall be placed into the mentioned rounded hole.

The left-bottom surface has two small rectangular holes, one being located in the upper left corner of the left-side bottom surface and the other being located in the upper right corner of the left-side bottom surface, so that two small connecting push-in members attached to a left replaceable cover could be respectively pushed into the mentioned two small rectangular holes.

The right-bottom surface of protruded-up middle part of housing containing a circuit board (denoted as "right-side bottom surface" below) also has a rounded hole on the surface so that a rounded cover of right emergency light shall be placed into the mentioned rounded hole.

The right-bottom surface also has two small rectangular holes, one being located in the upper left corner of the right-side bottom surface and the other being located in the upper right corner of the right-side bottom surface, so that two small connecting push-in members attached to a right replaceable cover could be respectively pushed into the mentioned two small rectangular holes.

The housing containing a circuit board has a bottom cover so that a circuit board shall be blocked not to be seen from outside.

Two respective movable emergency lights comprises first, two respective plastic ball-shaped covers containing an actual light in it and second, two respective transparent covers located on the top of two respective emergency ball-shaped lights.

Two respective plastic ball-shaped covers have two respective bottom holes on their respective south poles.

Two respective plastic ball-shaped covers have two protruded-up lines on their respective surface. The ends of two respective protruded-up lines has a form of cross-shaped lines.

Two respective plastic moving circle are located between two respective covers and two respective movable emergency lights as connecting to each other.

Two respective plastic moving circle have one protruded-up and square-shaped object on their respective surface.

Two respective replaceable covers have one blocking object on their respective surface.

BACKGROUND OF INVENTION

The present invention contrives to solve the disadvantages of the prior art. The prior art mentioned above is designed to automatically issue a light in case that there happens a power failure at night or in the evening at residence or building.

The function of present invention is exactly the same as one of the prior art. However, the present invention has a novel structure of the electricity light system housing and cover so that the cover could be easily replaceable if an owner wants to replace it.

The disadvantage of prior art is that an emergency light system cover is not replaceable and so, if an user wants to change a new shape of emergency light system cover since the shape became out of dated or broken, he or she has to buy a new type of both emergency light system cover and housing. Namely, in the prior art, the emergency light system cover is not replaceable.

The structure of emergency light system housing and cover in the prior art will produce more economic burden on the user of emergency light system since he or she has to always buy both the emergency light system cover and housing at the same time, even though he or she likes to buy only emergency light system cover but not housing.

In addition, the prior art was very difficult to move in any direction. However the present invention is designed to easily wove in any direction. The owner of present invention could shed a light in any direction by moving the present invention upwards, downwards, right-side or left-side due to the present invention's structure.

SUMMARY OF INVENTION

The present invention contrives to solve the disadvantages of the prior art. The present invention provides six connecting push-in members attached to two respective covers and six connecting holes located in the housing as shown in the claim and field section.

The object of the present invention is to attach the emergency light system cover to the emergency light system housing by using six connecting push-in members attached to two respective covers and six connecting holes located in the housing in the way mentioned in the claim and field.

The advantage of the present invention is to let an user of emergency light system housing and cover replace only the cover anytime without a need to replace the housing. When the user want to replace the outdated or broken shape of cover with a new one, the present invention would significantly reduce the economic burden on the user since the user could buy only the different shape of cover but not the housing due to the structure of newly invented emergency light system housing with two replaceable covers.

The second advantage of present invention is to freely change the direction of light since the light is designed to freely move downwards or upwards up to 80 degree and turn left-side or right-side to 360 degree.

BRIEF DESCRIPTION OF DRAWINGS

These and other features, aspects and advantages of the present invention will become better understood with reference to the accompanying drawings, wherein.

DETAILED DESCRIPTION EMBODIMENTS OF INVENTION

Figure 1:
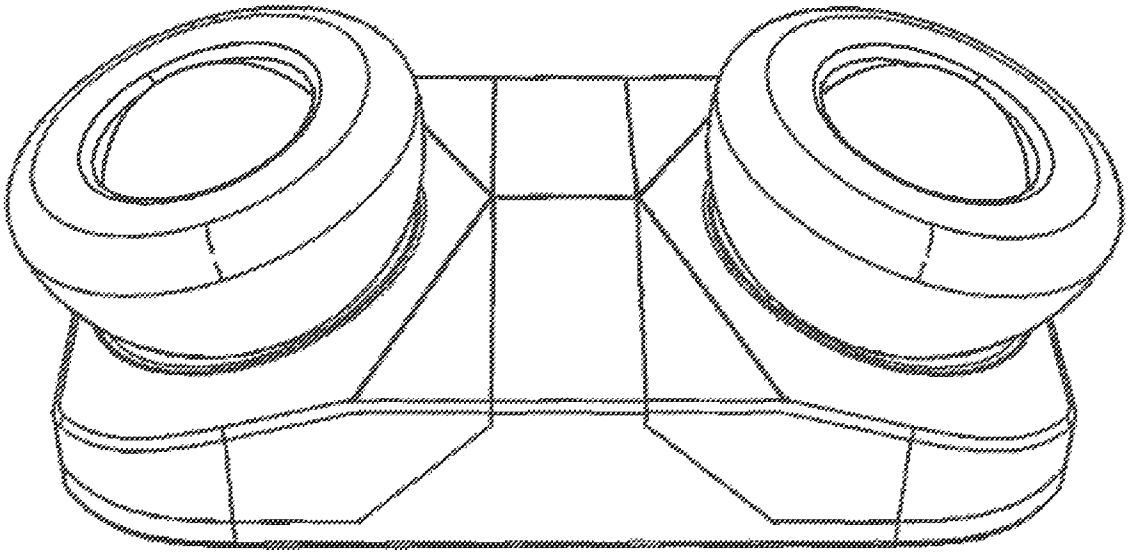
FIG. 1 shows a perspective view of an emergency Light system housing with two replaceable covers.
Figure 2:
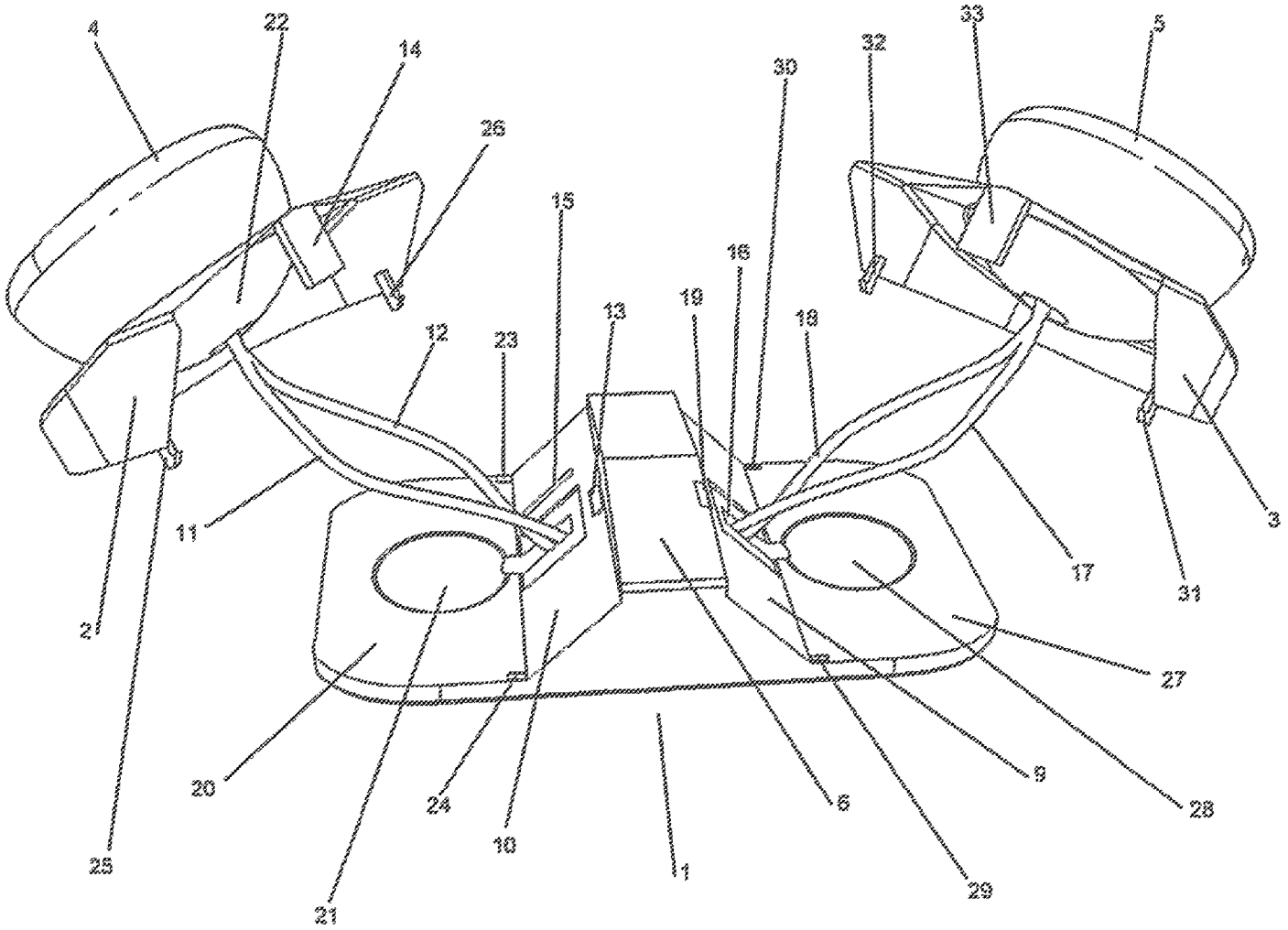
FIG. 2 shows a left-side perspective view of an emergency light system housing with two replaceable covers while a left-side replaceable cover is detached.
Figure 3:
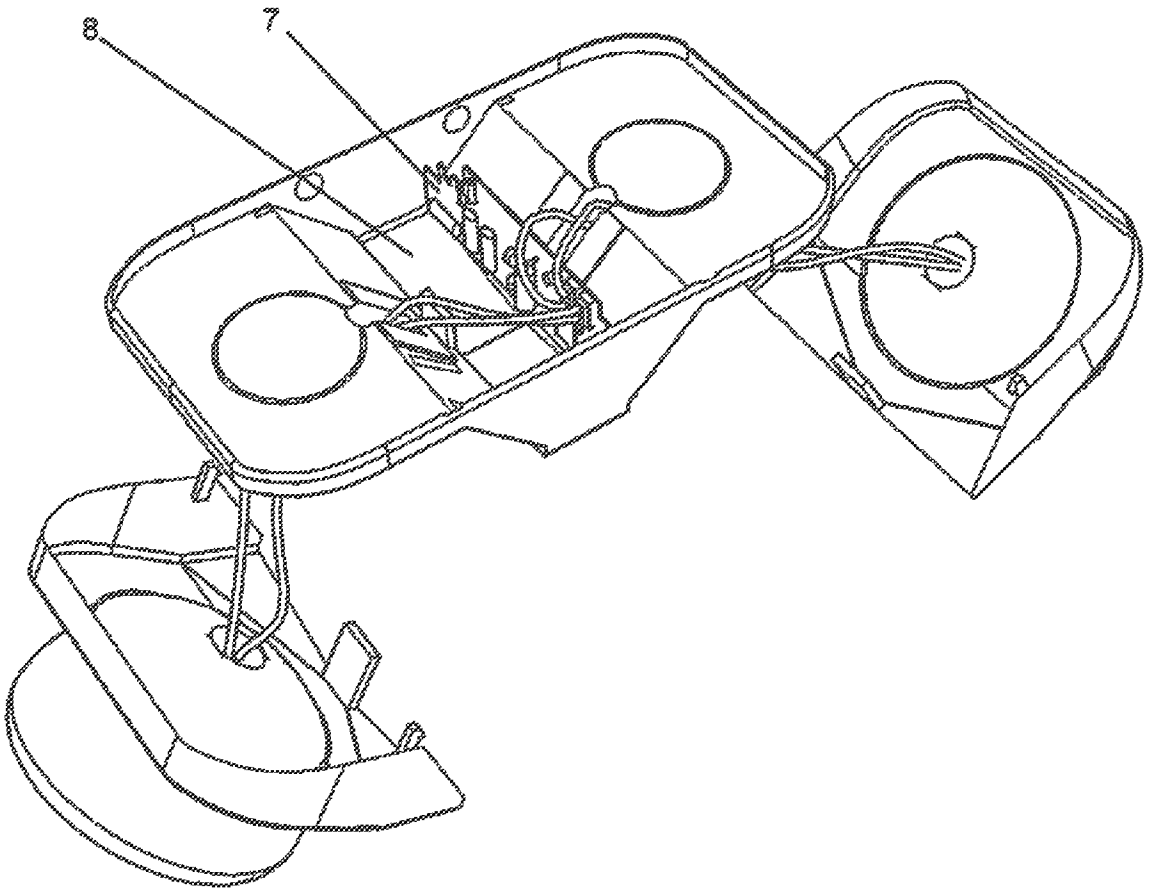
FIG. 3 shows a perspective view of the back of an emergency light system housing with two replaceable covers while two replaceable covers are detached and the bottom cover is detached.
Figure 4:
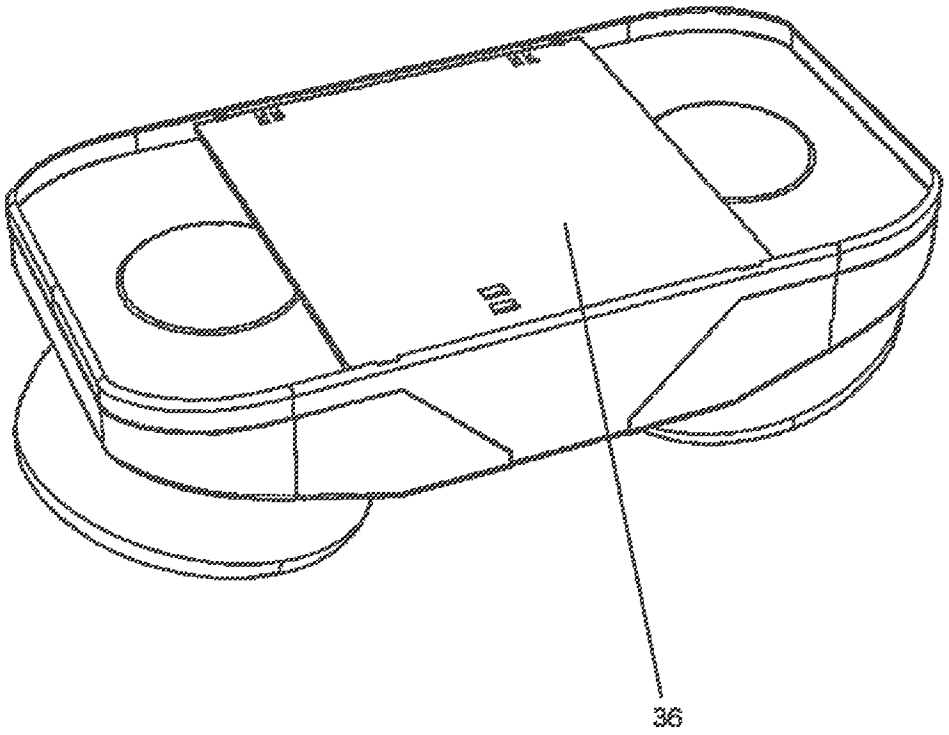
FIG. 4 shows a perspective view of the back of an emergency light system housing with two replaceable covers while two replaceable covers are attached and the bottom cover is attached.

Emergency light housing with two replaceable covers comprises first, a housing 1 containing a circuit board 7 and two respective covers 2, 3 with two respective emergency lights 4, 5 being attached.

The middle part 6 of the housing 1 protrudes up so that the circuit board 7 shall be placed in empty space 8 formed inside of protruded-up middle part of housing.

The protruded-up middle part 6 of housing 1 has both a right-sided 9 and a left-aided wall 10, which are slightly inclined.

The left-sided wall 10 has a long rectangular hole 34 located in the cotton middle of the left-sided wall so that two electric lines 11, 12 shall be connected between a left-sided emergency light 4 attached to the left-side replaceable cover 2 and a circuit board 7 located inside of protruded-up middle part 6 of housing 1.

There is a rectangular hole 13 in the upper middle of the left-sided wall 10 so that a connecting push-in member 14 attached to a left-sided replaceable cover 2 could be pushed into the mentioned rectangular hole 13.

There is another long rectangular hole 15 located in the left-side of the mentioned long rectangular hole so that air could freely circulate between the empty space B of housing containing a circuit board 1 and the replaceable cover 2 with emergency light 4 being attached while the housing 1 and two respective replaceable covers are being attached to each other.

The right-sided wall 9 has a long rectangular hole 16 located in the bottom middle of the right-sided wall 9 so that two respective electric lines 17, 18 shall be connected between a right-sided emergency light 5 attached to the replaceable cover 3 and a circuit board 7 located inside of protruded-up middle part 6 of housing 1.

There is a rectangular hole 19 in the upper middle of the right-aided wall 9 so that a long connecting push-in member 33 attached to a right-sided replaceable cover 3 could be pushed into the mentioned rectangular hole 19.

The left-side bottom surface of housing 1 has a rounded hole 21 on the surface so that a rounded cover 22 of left emergency light shall be placed into the mentioned rounded hole 21.

The left-side bottom surface of housing 1 also has two small rectangular holes 23, 24, one being located in the upper left corner 23 of the left-side bottom surface and the other being located in the upper right corner 24 of the left-side bottom surface, so that two small connecting push-in members 25, 26 attached to a left replaceable cover 2 could be respectively pushed into the mentioned two small rectangular holes 23, 24.

The right bottom surface 27 of housing 1 has a rounded hole 28 on the surface so that a rounded cover 35 of right emergency light shall be placed into the mentioned rounded hole 28.

The right bottom surface 27 of housing 1 has two small rectangular holes 29, 30, one being located in the upper left corner 29 of the right-side bottom surface and the other being located in the upper right corner 30 of the right-side bottom surface, so that two small connecting push-in members 31, 32 attached to a right replaceable cover 3 could be respectively pushed into the mentioned two small rectangular holes 29, 30.

The housing 1 has a bottom cover 36 so that a circuit board 7 shall be blocked not to be seen from outside.

Figure 5:
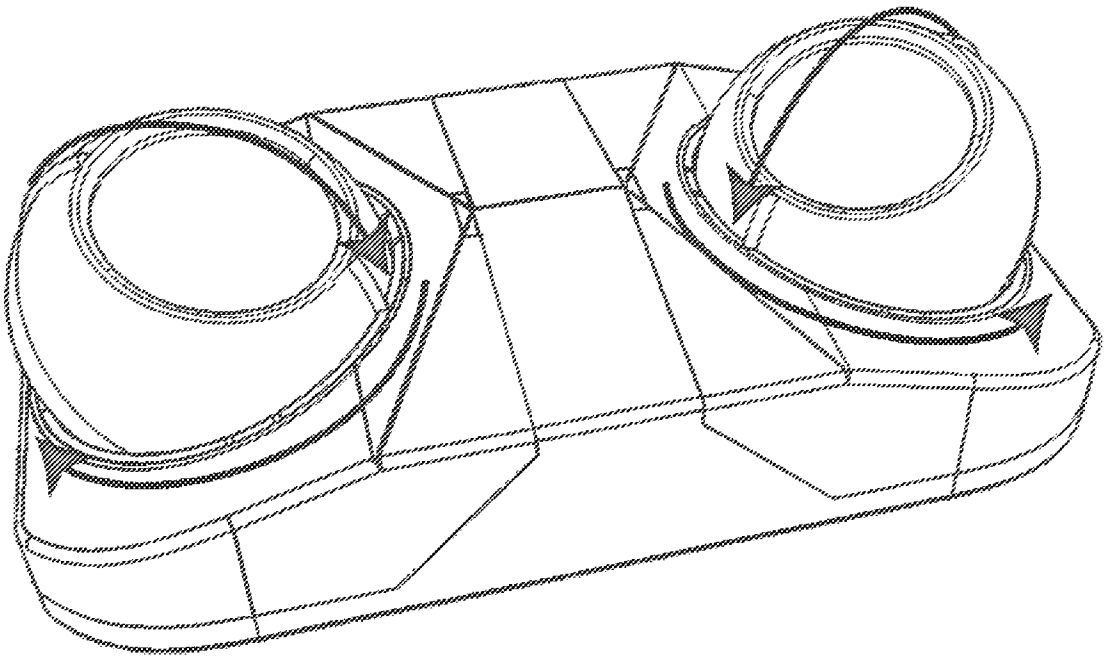
FIG. 5 shows a perspective view of an emergency Light system housing with two replaceable covers indicating through arrow marks that two respective movable emergency lights could move up or down and turn left-side or right-side up to 360 degree.
Figure 6:
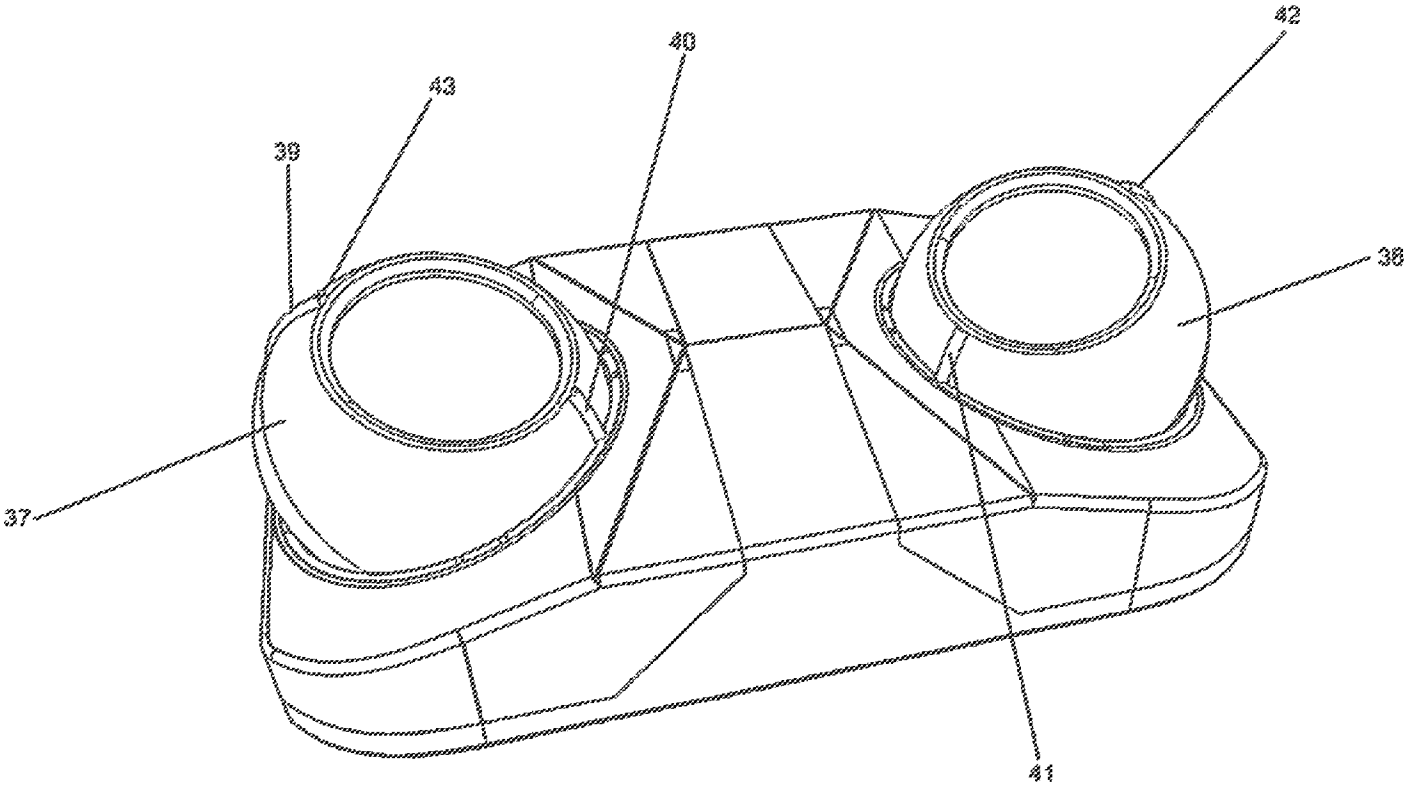
FIG. 6 shows a perspective view of an emergency Light system housing with two replaceable covers.
Figure 7:
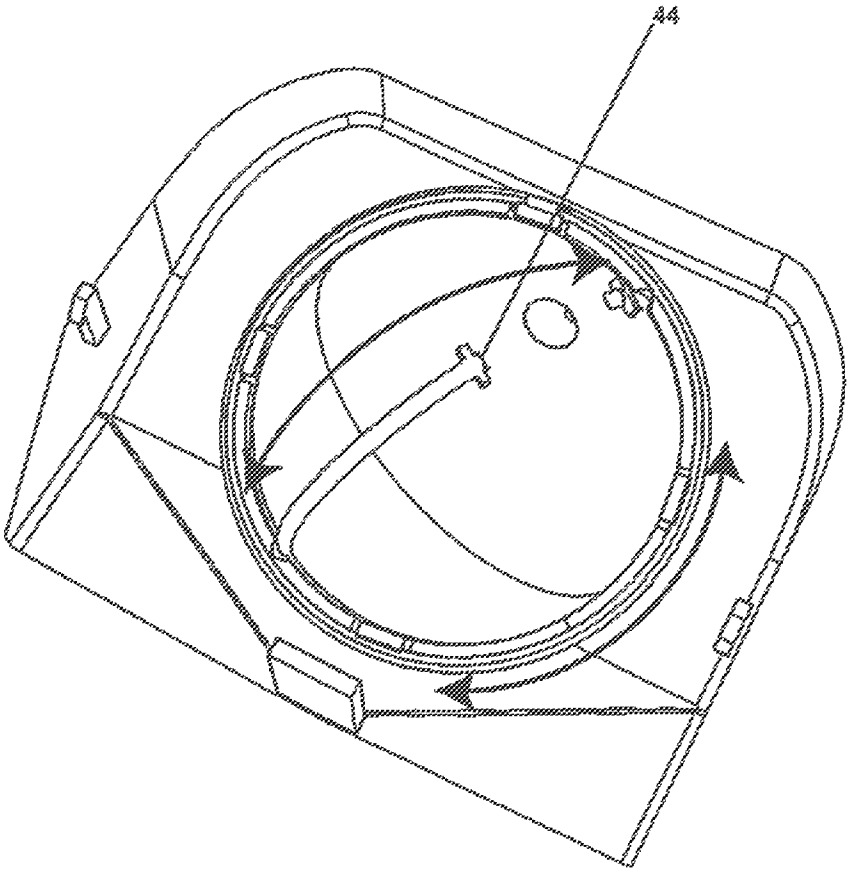
FIG. 7 shows a perspective view of inner shape of one replaceable cover with one movable emergency light being attached as indicating through two arrows that the movable emergency light could be moved upwards or downwards and turned right side or left side up to 360 degree.

FIG. 5 shows through two arrow marks that an emergency light attached to a replaceable cover could be turned right-aide or left-side up to 360 degree and 80 degree.

Two respective plastic ball-shaped covers 37, 38 have two protruded-up lines 39, 40, 41, 42 on each surface of two respective plastic ball-shaped covers. One protruded-up line extends from the end 43 of transparent cover to one centimeter 44 before two respective bottom holes.

Figure 8:
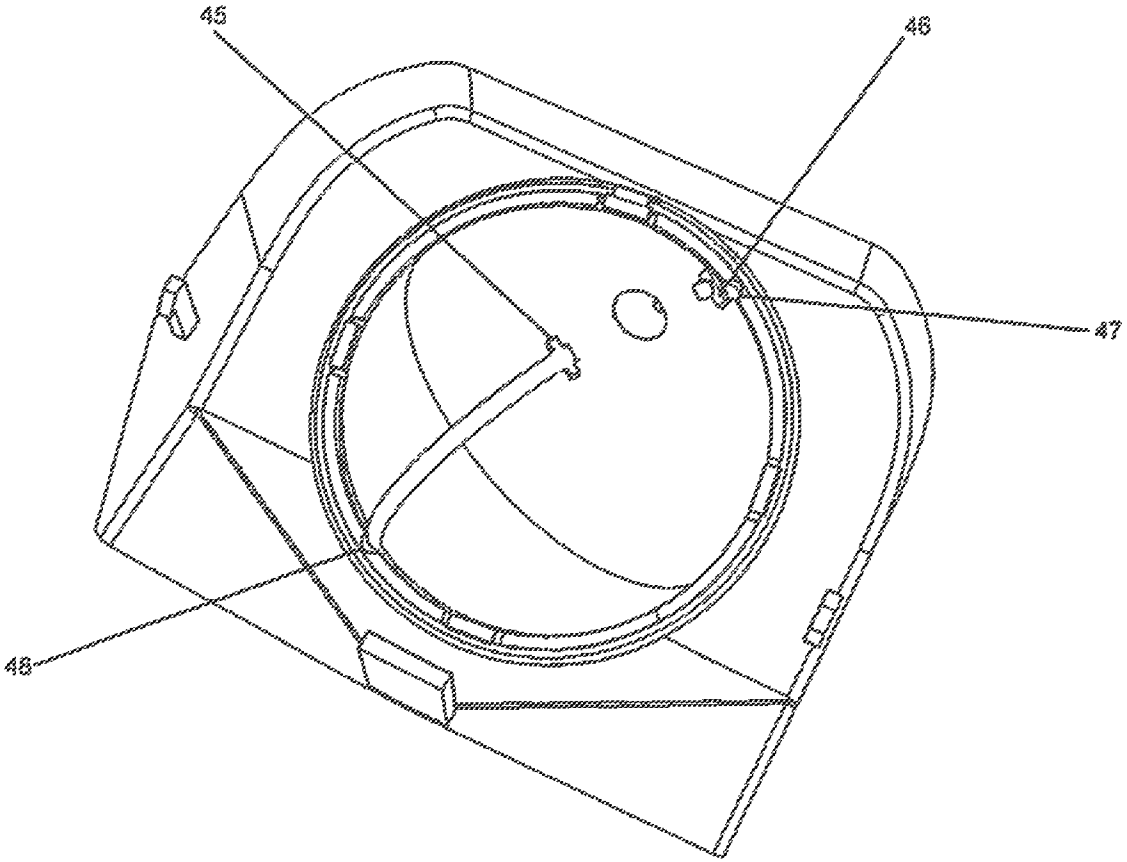
FIG. 8 shows a perspective view of inner shape of a right replaceable cover with one movable emergency light being attached.

The respective ends 45, 46 of two protruded-up lines, which are located in one centimeter before the respective bottom hole shown in FIG. 8, has a shape of cross 45,46 so that the respective protruded-up lines will be blocked by the respective holes 47, 48, which are smaller than two cross-shaped ends 45, 46 in width. Owing to these structurally blocking functions, two respective plastic ball-shaped covers cannot be turned upside-down.

The respective replaceable cover 51 is attached to the respective movable emergency light 49 through one plastic circle 50. The reason why the respective movable emergency light could be turned right-side or left-side up to 360 degree aa shown in FIG. 5 is that the plastic circle 50 is designed to move right side or left side.

The respective plastic circle has one protruded-up square-shaped object 52 and the respective replaceable cover has one blocking object 53.

Figure 9:
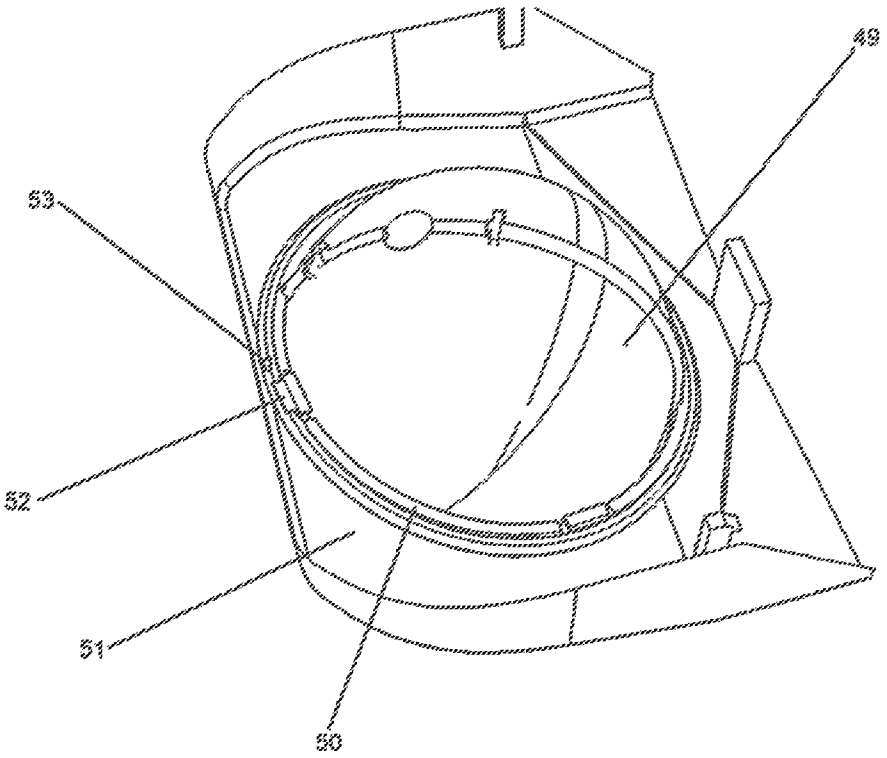
FIG. 9 shows a perspective view of inner shape of a left replaceable cover with one movable emergency light being attached, which shows that the light could be turned right-side up to 360 degree.
Figure 10:
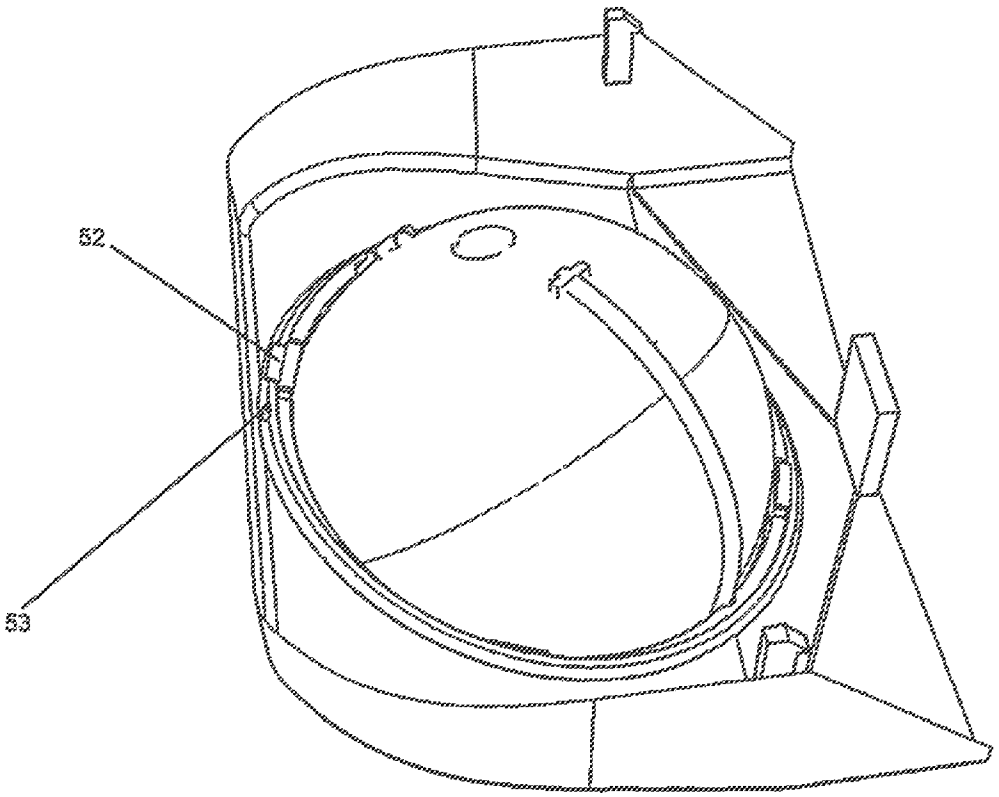
FIG. 10 shows a perspective view of inner shape of a left replaceable cover with one movable emergency light being attached, which shows that the light could be turned left-side up to 360 degree.
Figure 11:
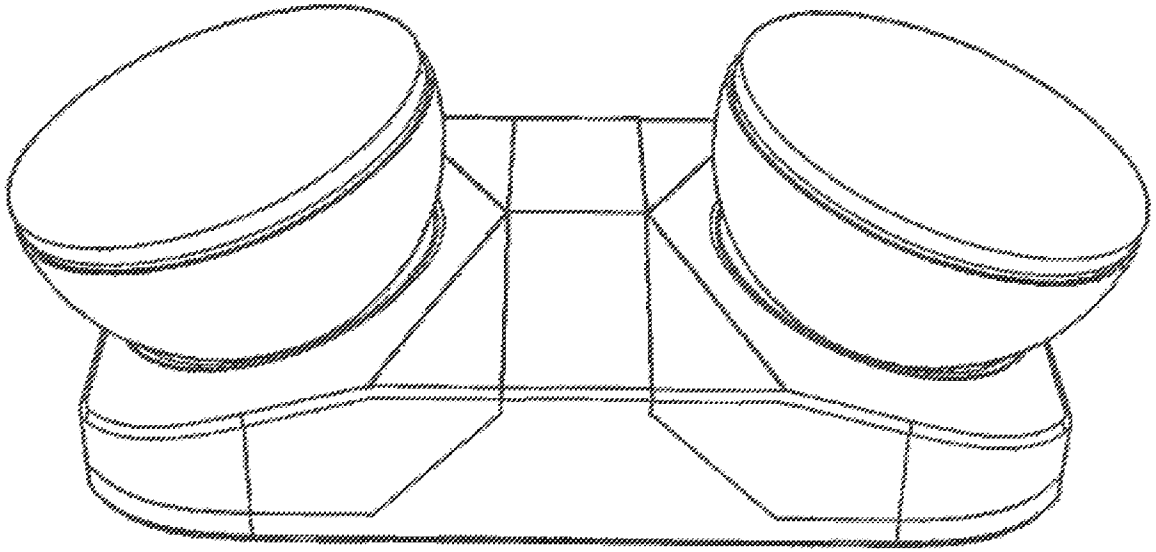
FIG. 11 shows a perspective view of the first different shape of emergency light system housing with two replaceable covers.
Figure 12:
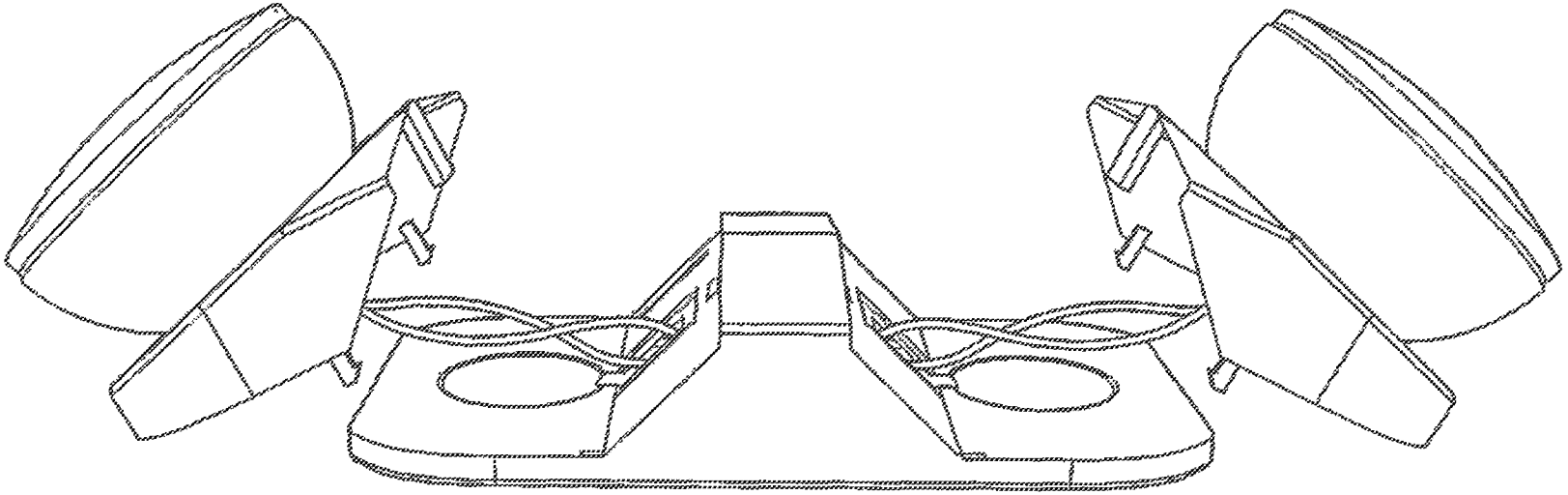
FIG. 12 shows a perspective view of the first different shape of emergency light system housing with two replaceable covers while two replaceable covers are detached.
Figure 13:
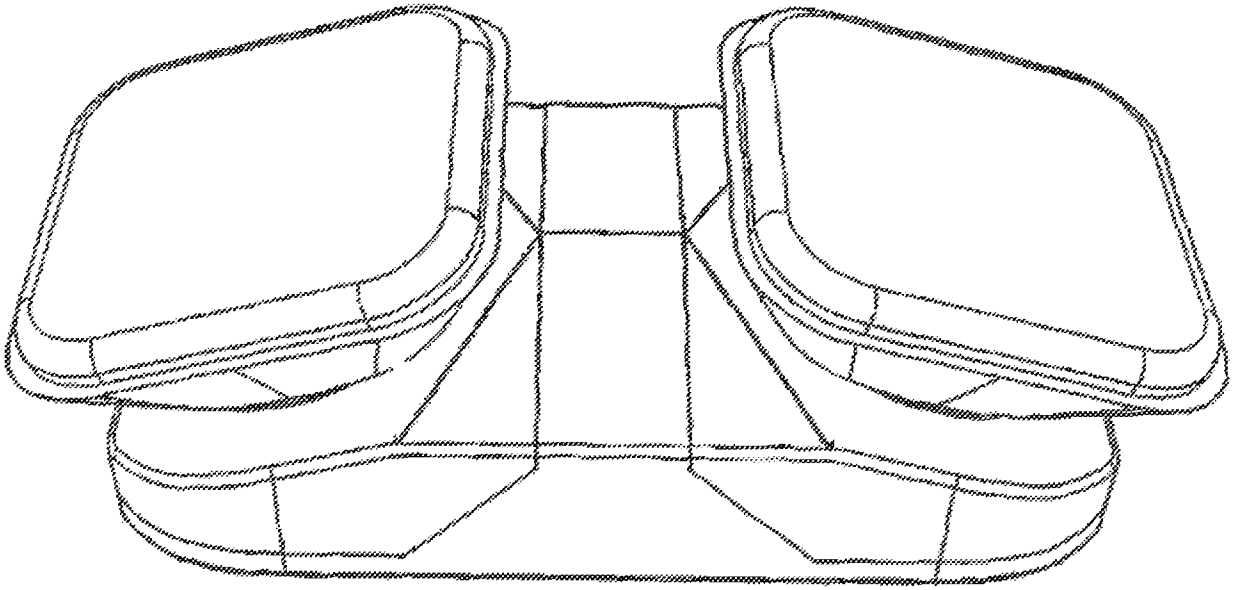
FIG. 13 shows a perspective view of the second different shape of emergency light system housing with two replaceable covers.
Figure 14:
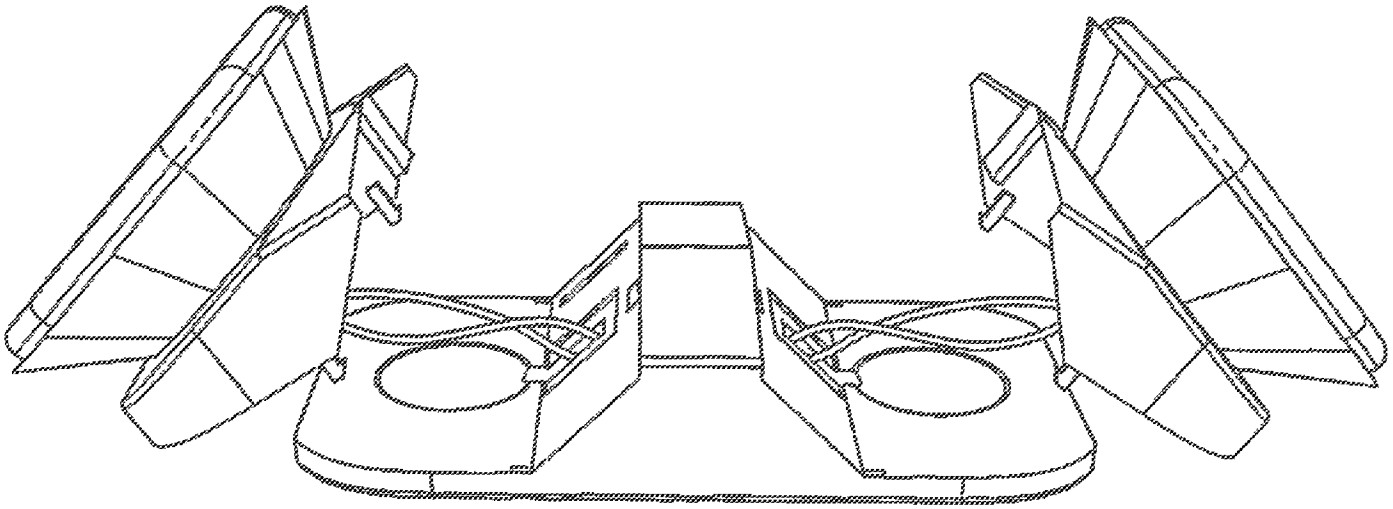
FIG. 14 shows a perspective view of the second different shape of emergency light system housing with two replaceable covers while two replaceable covers are detached.
Figure 15:
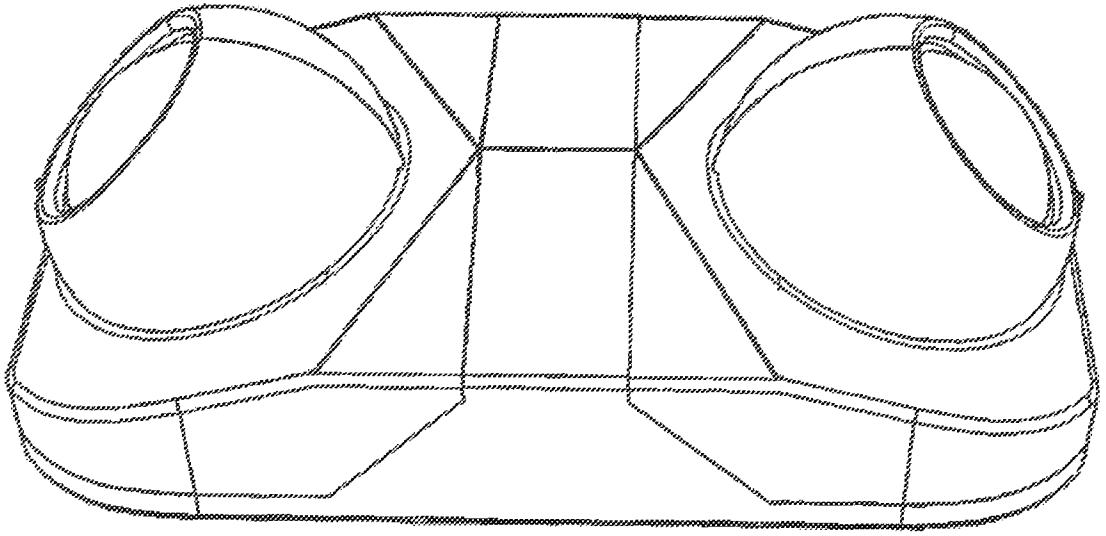
FIG. 15 shows a perspective view of the third different shape of emergency light system housing with two replaceable covers.
Figure 16:
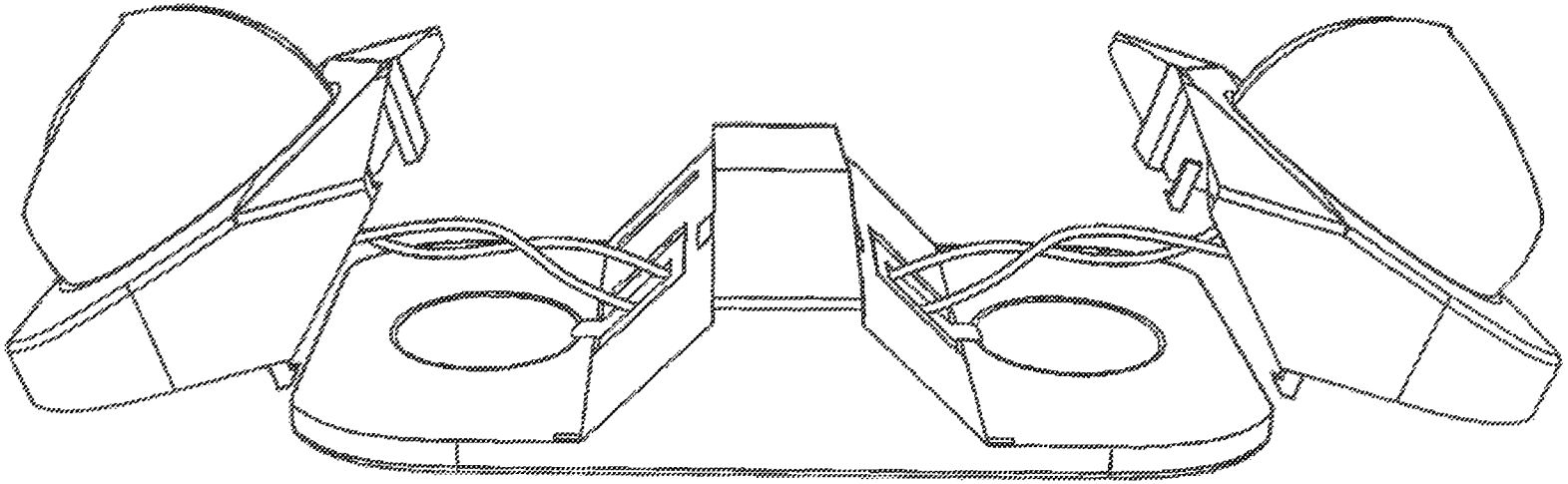
FIG. 16 shows a perspective view of the third different shape of emergency light system housing with two replaceable covers while two replaceable covers are detached.

The blocking object 53 prevents the respective movable emergency light attached to the plastic circle from being turned right-side beyond 360 degree due to protruded-up square-shaped object 52 in FIG. 9 or from being turned left-side beyond 360 degree due to protruded-up square-shaped object 52 in FIG. 10.

What is claimed is:

1. An emergency light housing comprising:

a first housing including:

a left-side bottom surface and a right-side bottom surface, and a middle part located between the left-side and the right side bottom surface, protrudes up from planes of the left-side and the right-side bottom surface, has a right-sided wall and a left-sided wall, and contains a circuit board inside;

a left-sided replaceable cover covering both the left-side bottom surface and the left-sided wall and having a first connecting push-in member and a right-sided replaceable cover covering both the right-side bottom surface and the right-sided wall and having a second connecting push-in member, wherein a first hole and a second hole are respectively located in the left-sided and the right-sided wall, and the first and the second connecting push-in member are respectively pushed into the first and the second hole, wherein a left-sided emergency light is located on the left-sided replaceable cover, and a right-sided emergency light is located on the right-sided replaceable cover, and wherein a third hole and a fourth hole are respectively located in the left-sided and the right-sided wall, electric lines are connected between the left-sided emergency light and the circuit board through the third hole, and other electric lines are connected between the right-sided emergency light and the circuit board.

2. The emergency light housing of claim 1, wherein the circuit board is placed in empty space inside of the middle part between the left-side and the right-side bottom surface.

3. The emergency light housing of claim 1, wherein the right-sided and the left-sided wall are slightly inclined.

4. The emergency light housing of claim 1, wherein the left-sided wall has another long rectangular hole so that air could freely circulate between the first housing and the left-sided replaceable cover while the first housing and the left-sided replaceable cover are attached to each other.

5. The emergency light housing of claim 1, wherein each of the third and fourth hole has long rectangular shape, wherein the third hole is located in a bottom middle of the left-sided wall, and the fourth hole is located in a bottom middle of the right-sided wall.

6. The emergency light housing of claim 1, wherein the left-side bottom surface has a rounded hole so that a rounded cover of the left-sided emergency light shall be placed into the rounded hole, wherein the left-side bottom surface has two small rectangular holes, one of the two small rectangular holes is located in an upper left corner of the left-side bottom surface, and the other of the two small rectangular holes is located in an upper right corner of the left-side bottom surface, and wherein two small connecting push-in members attached to the left-sided replaceable cover are respectively pushed into the two small rectangular holes.

7. The emergency light housing of claim 1, wherein the right-side bottom surface has a rounded hole so that a rounded cover of the right-sided emergency light shall be placed into the rounded hole, wherein the right-side bottom surface has two small rectangular holes, one of the two small rectangular holes is located in an upper left corner of the right-side bottom surface and the other of the two small rectangular holes is located in an upper right corner of the right-side bottom surface, and wherein two small connecting push-in members attached to the right-sided replaceable cover are respectively pushed into the two small rectangular holes.

8. The emergency light housing of claim 1, wherein the first housing has a bottom cover so that a circuit board shall be blocked not to be seen from outside.

9. The emergency light housing of claim 1, each of the left-sided and the right-sided emergency light comprises a plastic ball-shaped covers containing an actual light in it and a transparent covers located on a top of the plastic ball-shaped lights.

10. The emergency light housing of claim 9, wherein the plastic ball-shaped cover has a bottom holes on a south poles of the plastic ball-shaped covers, and electricity lines are connected to the circuit board through the bottom hole, wherein the plastic ball-shaped cover has two protruded-up lines on the surface of the plastic ball-shaped cover, one of the two protruded-up lines extends from an end of the transparent cover to one centimeter before the bottom hole and the other of the two protruded-up lines extends from the opposite end of the transparent cover to one centimeter before the bottom hole, and wherein each of ends of two protruded-up lines located in one centimeter before the bottom holes has a protruded-up cross-shaped lines so that the protruded-up cross-shaped line prevents the left-sided and the right-sided emergency lights from becoming upside-down.

11. The emergency light housing of claim 1, wherein the left-sided replaceable cover has a plastic circle connecting between the left-sided replaceable covers and the left-sided-emergency lights, and the right-sided replaceable cover has a plastic circle connecting between the right-sided replaceable cover and the right-sided emergency light.

12. The emergency light housing of claim 11, the plastic circle has a protruded-up and square-shaped object.

13. The emergency light housing of claim 11, wherein each of the left-sided and the right-sided replaceable cover has a blocking object inside of each of them to prevent each of the left-sided and the right-sided emergency light from turning left or right side beyond more than 360 degree.

* * * * *